United States Patent [19]

Goldfarb et al.

[11] 4,045,906

[45] Sept. 6, 1977

[54] PLAY DEVICE FOR SUSPENDING AND MOVING A FLOATABLE OBJECT RELATIVE TO MOVABLE AREAS

[76] Inventors: Adolph E. Goldfarb, 4614 Monarca Drive, Tarzana, Calif. 91356; Erwin Benkoe, 17965 Medley Drive, Encino, Calif. 91316

[21] Appl. No.: 657,484

[22] Filed: Feb. 12, 1976

[51] Int. Cl.[2] ..... A63H 29/16; A63H 33/26

[52] U.S. Cl. ..... 46/44; 273/101; 46/248

[58] Field of Search ..... 46/44, 248; 124/62; 273/101

[56] References Cited

U.S. PATENT DOCUMENTS

| | | | |
|---|---|---|---|
| 3,082,570 | 3/1963 | Pearson, Jr. | 46/44 |
| 3,115,343 | 12/1963 | Lemelson | 46/44 |
| 3,477,723 | 11/1969 | Djedda | 273/101 |
| 3,731,421 | 4/1971 | Frattolillo | 46/248 |
| 3,885,344 | 5/1975 | Tong | 46/44 |

*Primary Examiner*—Russell R. Kinsey
*Assistant Examiner*—Robert F. Cutting
*Attorney, Agent, or Firm*—Robert M. Ashen; Robert J. Schaap

[57] ABSTRACT

A play device for suspending a floatable object such as a foam plastic ball or a ping pong ball in an air stream and selectively manipulating the direction and position of the air stream so as to move the ball into areas defined by movable structures. The structures are themselves movable when contacted by the air stream to thereby move the ball-receiving areas and increase the difficulty and excitement of the play of the device. The areas may comprise passageways completely through the movable structures or may be the entrances to receptacles in which the ball may be received or may be defined areas adjacent to portions of the structures. The air stream may be provided by a hand-held blower unit which preferrably includes a cradle for the ball. The cradle includes apertures or openings therein which permits the ball to be lifted by the air stream from a starting position in the cradle and suspended in the air stream a substantial distance above the cradle. This permits the ball to be moved relative to the areas without the blower making physical contact with the movable structures which define the areas.

The air stream may have a generally constant thrust so as to maintain the ball a generally constant and predetermined distance from the blower unit. Movement of the ball is accomplished by varying the location of the blower unit (i.e. up, down, or to the side) and by varying the orientation of the unit (i.e., its angle or level, front to back and side to side).

18 Claims, 12 Drawing Figures

PLAY DEVICE FOR SUSPENDING AND MOVING A FLOATABLE OBJECT RELATIVE TO MOVABLE AREAS

The present invention relates generally to the type of play device wherein a floatable object is suspended on an air stream.

There have been prior art devices in the form of target games where a lightweight ball or ping pong ball was suspended in an air stream in essentially one position, the ball provided a target; the players were provided with shooting means as for example projectable darts which they attempted to aim so as to strike the suspended ball to move it out of the air stream which would cause it to fall and would constitute a hit. This type of prior art device also took the form of a ball suspended above a moving vehicle, such as a toy railroad train; in this case, the suspended ball moved with the railroad train and thus not relative to it.

Another form of prior art device was a coin-operated machine which provided an air stream that passed upwardly through a screen or the like into an enclosed compartment. A ball, such as a ping pong ball, would be suspended on the stream in the compartment and the device included externally operable control means such as two joy sticks which could be operated to control the force as well as the direction of the air stream so as to move the ball relative to a series of fixed obstacles in the compartment. The obstacles were mounted in fixed positions and were not moved or affected by the action of the air stream.

The device of the present invention contemplates the use of movable means which define areas for receipt of a suspended or floated object such as light-weight ball, with the movable means being sensitive to and moved by contact of the air stream. This increases the difficulty and interest in the play of the device. In an illustrated preferred form, the air stream may be provided by a hand-held blower unit having a single fixed force for the air stream but being capable of being manipulated (i.e. moved about) to selectively vary the direction and position of the air stream. The unit may include a cradle for the ball, the cradle having openings therein which permits the ball to be lifted by the air stream from a starting position in the cradle to a substantial distance above the cradle. This permits the ball to be sufficiently spaced from the blower unit so that the ball can be moved relative to the movable means without the blower unit physically contacting the movable means. The areas defined by the movable means may comprise passageways completely through such movable means, or receptacles in which the ball may be received, or areas adjacent to portions of the movable means. In the operation of the device, the ball may be moved to and/or through a selective series of the areas, caused to come to rest in a receptacle and then caused to be lifted by the air stream from the receptacle for further movement.

In the forms of the movable means or structures illustrated in the drawings, such movable structures are rotatably mounted at the upper end of upright self-standing standards or poles and the movements may be simple or complex. Further, the portion of the movable structure which is caused to move by the air stream may be different from the portion of the movable structure which defines the area for receiving the object . In this regard for example, a rotatable propeller might be rotatingly mounted on an aperture-defining member which is in turn rotatably or otherwise movably mounted. When the air stream contacts the propeller causing it to rotate, this will impart movement to the aperture-defining member to thereby increase the difficulty of causing the object to pass through or into that aperture.

IN THE DRAWINGS

Figure 1:
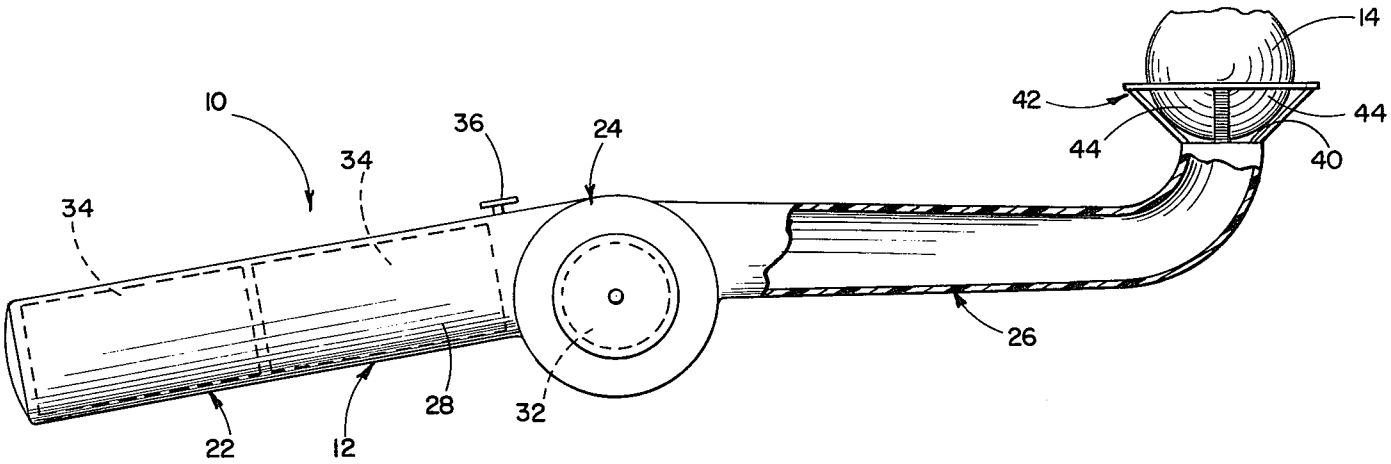
FIG. 1 is a side view partially in section of a blower unit comprising a portion of the presently preferred embodiment of the invention.
Figure 2:
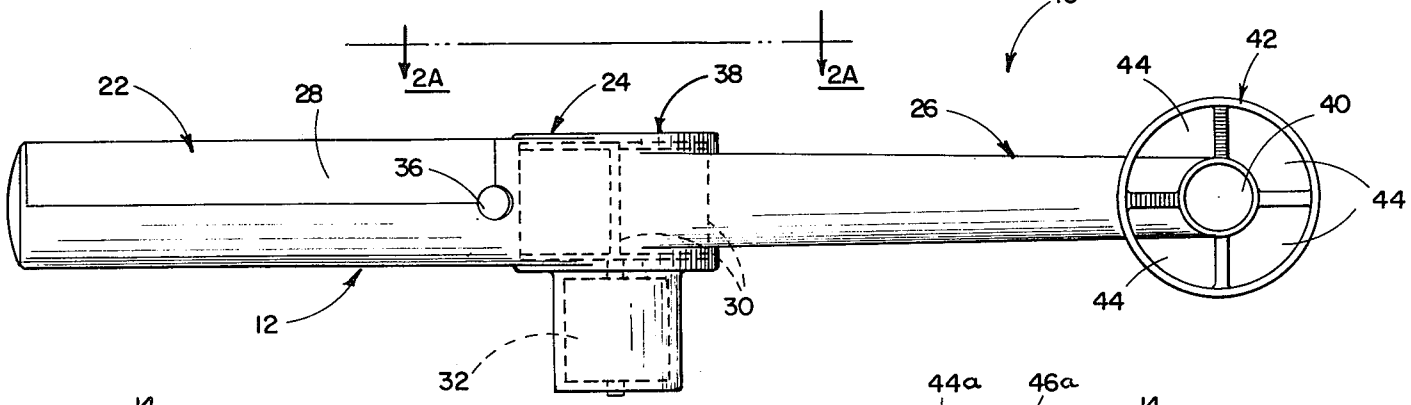
FIG. 2 is a top plan view of the blower unit of FIG. 1.

In general, a presently preferred embodiment of the present invention is designated 10 and is illustrated in the drawings, FIGS. 1 through 7. In the illustrated play device 10 a hand-holdable self-contained blower unit 12 shown in FIGS. 1 and 2 provides a generally constant thrust air stream on which a floatable object such as a light-weight foam ball 14 may be suspended at a position spaced away from the blower unit. Various means are provided to define areas 20 to which the ball is to be positioned by being moved thereto by the air stream. The illustrated forms of these means shown in FIGS. 3–7 each comprise generally upright self-standing support or poles 18 on which area-defining members 16 are movably mounted. The poles 18 stand on a suitable supporting surface such as a table or the floor and the areas 20 for receipt of the object are spaced a substantial distance above that supporting surface. The area-defining members 16 are constructed so that they will move when contacted by the air stream to thereby move the location of the areas 20 into which the player is trying to move the object. This can greatly increase the difficulty and the skill required to successfully play with the device.

The play of the device comprises generally supporting the ball 14 in the air stream provided by the blower unit 12 and manipulating or moving about the blower unit to vary the direction and position of the air stream to thereby effect desired movement of the ball relative to the areas 20 defined by the movable members 16. In this connection is may be desired to pass the ball through an aperture, to cause the ball to come to rest in a receptacle, or to merely move the ball along some pathway or route relative to the movable members. In accomplishing these tasks of moving the ball relative to the movable members, the user must take into consideration and deal with the movement which may be imparted to the movable members themselves by the action of the air stream. In other words, for example, if the ball is to be moved through an aperture in a member which is itself movable, movement of that member by the air stream makes it substantially more difficult to effect passage of the ball suspended on the air stream through that aperture.

Now referring to the illustrated device 10 in further detail, the hand-holdable blower unit 12 shown in FIGS. 1 and 2 is a generally elongated wand-type structure having a handle section 22 at one end, a blower section 24 adjacent the handle section, and a generally tubular outlet section 26 at the opposite end from the handle section. The unit 12 may comprise a housing 28 of plastic or other suitable material formed in one or more sections which may be secured together by suitable fasteners such as screws (not shown). The housing 28 contains a rotor element 30 which is operatively coupled to an electric motor 32 also contained within the housing. The motor 32 may be powered by suitable batteries 34 mounted in the illustrated device in the handle section 22. An "off-on" switch 36 may be provided on the housing for manual operation to open and close the circuit between the batteries and the motor to turn the motor on and off, When the motor is turned on, it imparts rotation to the rotor element 30. Air is drawn into the housing at an inlet 38 and blown through the tubular outlet section 26 to an outlet 40 at the front of the blower unit. The illustrated unit includes a cradle or holder 42 for the ball at the outlet 40. The cradle 42 defines a generally conical receptacle that faces or opens generally upwardly. The ball may be received in and supported in the cradle. Apertures or openings 44 are provided around the periphery of the cradle. It has been found that without such apertures, the air flow through the blower will escape around the edges of the ball, causing reduced pressure beneath the ball and thereby tending to maintain the ball in close proximity to the outlet of the blower. The provision of the openings 44 around the cradle permits the ball to be raised from a resting position in the cradle to a position in the air stream substantially above the outlet of the blower unit. For a given blower unit which develops a specified thrust for an air stream and for a given ball size and weight, the position of the ball relative to the blower outlet will be at a generally constant and predetermined distance. When the blower unit is turned off, the ball can settle back into the cradle and be maintained therein until it is desired to operate the blower again.

Figure 9:
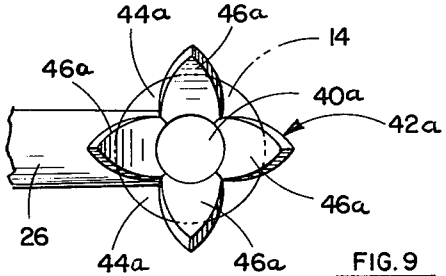
FIG. 9 is a top plan view of the outlet end shown in FIG. 8.
Figure 2A:
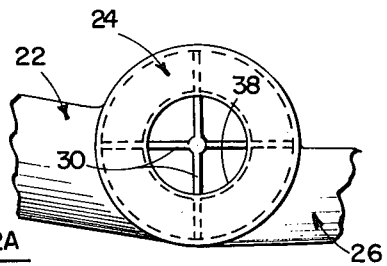
FIG. 2A is a partial side view of the blower unit taken generally along line 2A—2A of FIG. 2.
Figure 8:
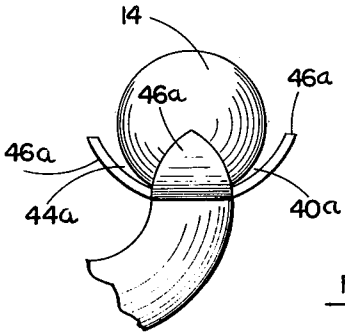
FIG. 8 is a side view of a modified form of outlet end for a blower unit.

FIGS. 8 and 9 show a modified form of blower outlet **40*a* and cradle arrangement 42*a* where, in essence, four equally spaced fingers or petals 46*a* define the cradle or receptacle structure. It should be noted that there is sufficient space or openings 44*a* between the adjacent petals 46*a* to permit the ball to be elevated by the air stream from a starting position in the cradle 42*a*.**

Figures 3, 4:
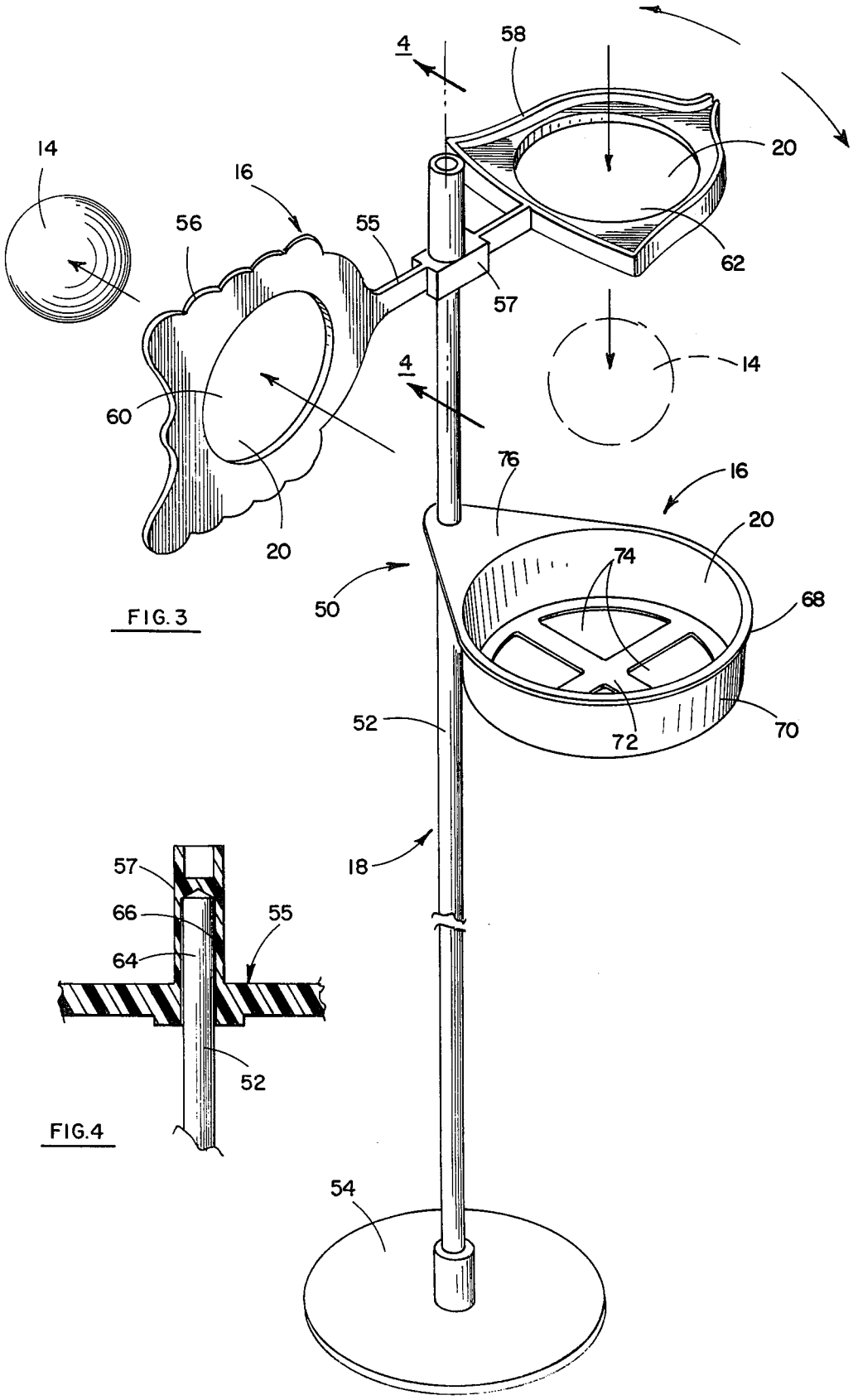
FIG. 3 is a side elevational view of a self-standing structure which defines movable object-receiving areas.
FIG. 4 is an enlarged sectional view taken generally along line 4—4 of FIG. 3.

As shown in FIG. 3, an illustrative area-defining structure 50 comprises the stand or support 18 which includes an upright post 52 and a base 54 secured to the lower end of the post. The base 54 may be disposed on a supporting surface such as a table or the floor and it will maintain the post 52 in a generally vertical upright position. Movably mounted at the upper end of the post is a movable area-defining member 16 in the form of a molded arrow-shaped plastic part 55. The part 55 includes generally vertically and horizontally disposed flat plate-like sections 56 and 58 respectively, connected by a center section 57. The members 16 may take various other desired configurations such as that of the outline of a fish or animal. The sections 56 and 58 each have an aperture 60, 62 therethrough which is sufficiently large to permit passage therethrough of the ball 14. The part 55 is mounted on the upper end 64 of the post 52 for rotation about the vertical axis of the post. More particularly, the center section 57 of the part 55 defines a receptacle 66 into which the upper end 64 of the post is received. The aperture 60 is at one side of the post while aperture 62 is at the opposite side of the post. Mounted on the post below the part 55 is another member 16 in the form of a molded receptacle-forming part 68 which defines an upwardly facing receptacle proportioned to receive and hold the ball therein. The receptacle forming part 68 may also be mounted on the post 52 for rotation about the vertical axis of the post. The receptacle forming part 68 includes a solid annular peripheral wall 70 and a bottom wall 72 which is perforated or has openings 74 therethrough and a connector or tab section 76 which is rotatably mounted on the post. The openings 74 facilitate the passage of portions of the air stream therethrough so that control of the ball may be maintained when the ball is located above and in the receptacle part 68. It also permits the ball to be lifted by the air stream out of the receptacle part 68 and moved to subsequent desired positions.

In play with the device, it may be an objective to cause the ball to pass through the aperture 60 in the vertically disposed section 56 and to then pass through the aperture 62 in the horizontally disposed section 58, finally coming to rest in the receptacle part 68. It may then be an objective to raise the ball out of the receptacle part 68 (and if desired, also back up through the aperture 62 in the horizontally extending section 58) and then to move the ball to a subsequent location. It will be noted that in accomplishing the foregoing manipulation of the ball on the air stream, both of the area-defining members 55 and 68 are movable on the post and will be moved when contacted by the air stream. Thus, the user must not only manipulate the direction of the air stream and the height of the ball by raising and lowering the blower unit, but he must also take into consideration movement of the area-defining movable members. In this connection, it is not only desirable to avoid causing inadvertent movement of such movable members, but it may be necessary or desirable to utilize the air stream to move the movable elements into certain positions as in connection with the structure of FIG. 3 to move the aperture 62 in alignment above the receptacle part 68.

Figure 6:
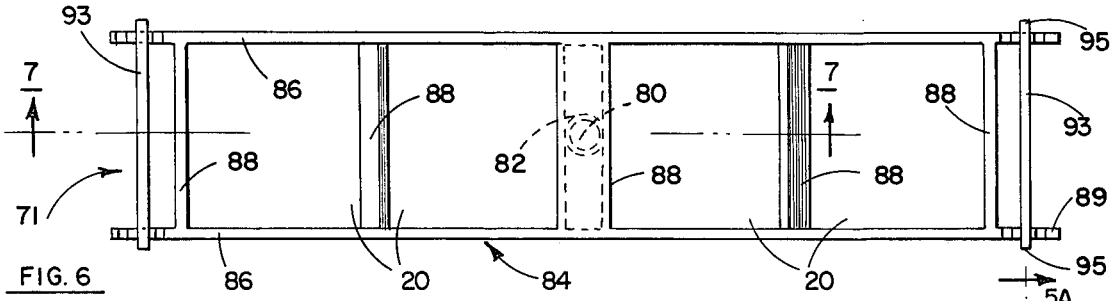
FIG. 6 is a top plan view of the structure of FIG. 5.
Figure 5:
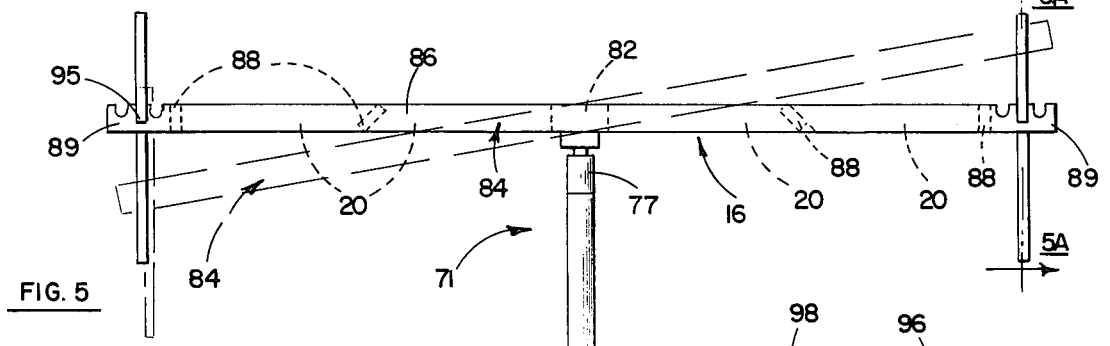
FIG. 5 is a side elevational view of another form of area defining structure for a presently preferred embodiment of the invention.
Figure 5A:
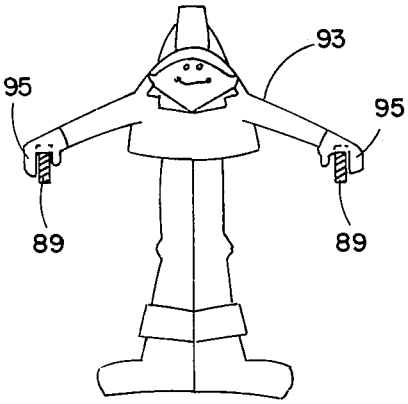
FIG. 5A is an enlarged sectional view taken generally along line 5A—5A of FIG. 5.
Figure 7:
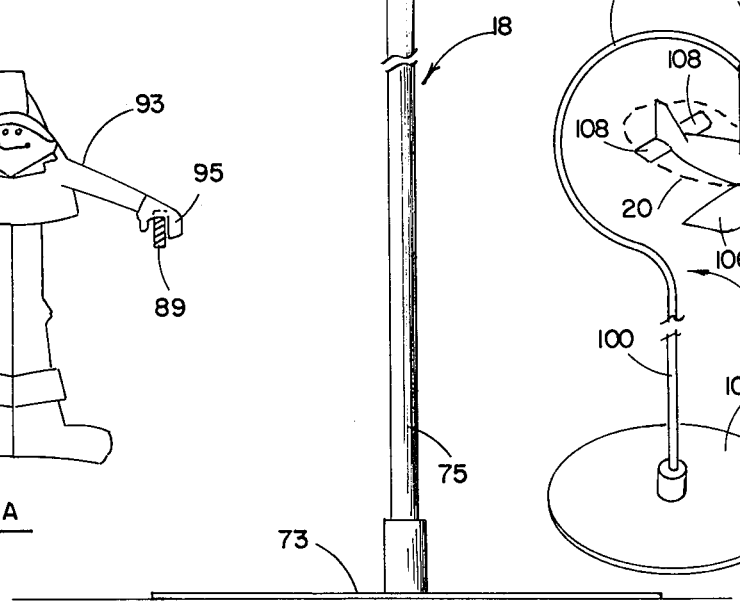
FIG. 7 is an enlarged sectional view taken generally along line 7—7 of FIG. 6.
Figure 7:
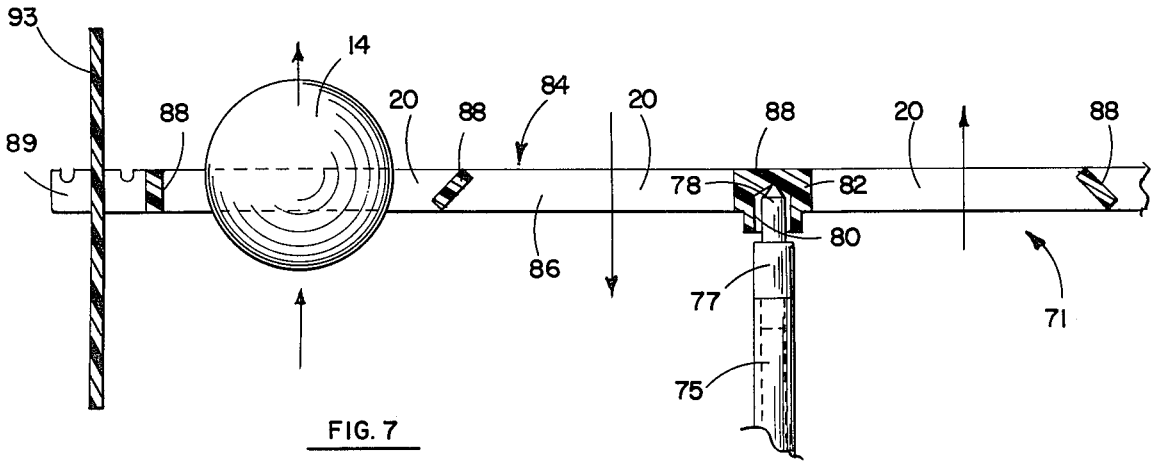

FIGS. 5, 6 and 7 illustrate an alternate area-defining structure 71 comprised of a generally upright self-standing standard 18 on which an area-defining member 16 is rotatably mounted. The standard for the structure 71 comprises a base 73 on which is mounted an upright post 75. At the upper end of the post 75 an end piece 77 is provided. The end piece 77 has an upwardly directed, reduced diameter pin portion 78 (see FIG. 7) which is pointed at its upper end. The pin portion 78 is received within a receptacle 80 which faces downwardly and is formed in a central mid-portion 82 of a ladder-like molded part 84 which comprises the movable member for the area-defining structure 71. Thus, the part 84 has a pair of elongated side rail portions 86 and five generally equally spaced rung portions 88. The two end rung portions are disposed generally vertically while the two intermediate rung portions are disposed on a generally 45° angle from the vertical. This angular disposition causes the intermediate rung to be impinged upon and the ladder-like part 84 rotated by a vertical stream of air abutting the intermediate rung 88. The central rung 88 defines the center piece 82 described above. Each side rail portion 86 has an extension 89 at either end formed with a series of three upwardly facing notches 91. A stabilizing part in the form of a clown FIG. 93 shown in FIG. 5A is supported at either end of the ladder-like part 84. Each clown FIG. 93 has a pair of outwardly extending arms 85 which interengage with the notches 91 of the end extensions 89 to support the clown FIG. 93 on the part 84. The clown FIGS. 93 stabilize the part 84 and limit its speed of rotation. The FIGS. 93 may be selectively positioned in the notches 91 and thus relative to the ends of the part 84 to balance the part 84 from end to end.

FIG. 7 illustrates the ball 14 being moved by the air stream upwardly between one of the end rungs 88 and adjacent intermediate rung 88. As the next step, the ball could be moved by the air stream to a location above the openings defined between the intermediate rung and the center rung and then the ball could be caused to move downwardly through that opening. It will be noted that the part 84 is rotatable on the standard 18. Further, as shown in FIG. 7, the pin 78 is substantially smaller than the receptacle 80 which permits tilting of the ladder-like part 84 to a position such as shown in broken lines in FIG. 5. Thus, not only can the part 84 rotate under the impact of the air stream, but it may also be caused to tilt, all of which adds to the difficulty of moving the ball relative to the openings 20 defined between the rungs.

Figure 10:
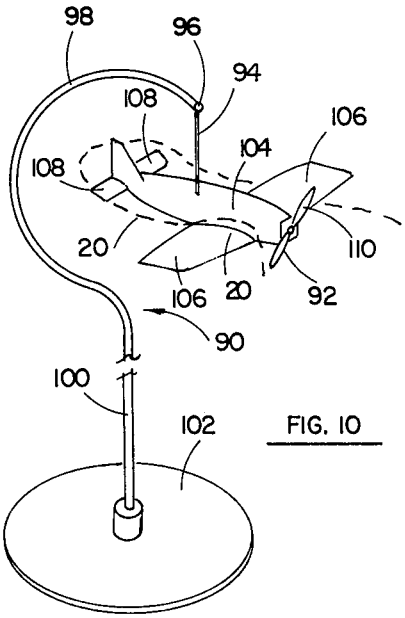
FIG. 10 shows another form of area-defining structure.

FIG. 10 shows another form of movable area-defining structure 90 comprising a toy airplane 92 suspended by a cord 94 from the upper end 96 of the curved post 98 of a self standing support 100. The support 100 also includes a base 102 to which the lower end of the post 98 is secured. The toy airplane 92 has a body 104, a pair of outwardly extending wing sections 106, and a pair of outwardly extending tail sections 108. A propeller 110 is rotatably mounted at the front end of the toy airplane body 104. It may be the objective to move the ball 14 in the air stream over some predetermined path relative to the toy airplane such as over a first wing section 106, under the adjacent tail section 108, over the other tail section, and under the other wing section. Thus, the areas 20 to which the ball is to be moved are adjacent to the movable structure, as for example the area above the first wing section and the area between that wing section and the adjacent tail section.

The air stream containing the toy airplane 92 will cause it to sway or move at the end of the cord 94. The air stream contacting the propeller 110 so as to cause it to rotate will thereby also indirectly cause movement of the entire toy airplane.

The illustrated ball 14 is generally spherical and is of a relatively light-weight construction. It may be constructed of a light-weight plastic foam material such as styrofoam or it may comprise a conventional ping pong ball. It will be noted that the object or ball need not be perfectly round and smooth externally. For example, it may be comprised of a plurality of small generally flat surfaces, may be egg-shaped or oblong in configuration, and it may have some indentations and irregularities in its surface. It will be noted however that it should be generally or essentially spherical in configuration so that it can be reasonably controlled by the air stream. If the irregularities are too great or the shape is too irregular, the object will move in sudden and erratic movements and will be difficult if not impossible to maintain in the air stream.

By way of example, a workable and effective device has been found to be provided by the utilization of fractional horse-power electric motor driven by two size "D" batteries. The rotor or blower had a 2-inch diameter and rotated at approximately 11,000 RPM. The outlet tube diameter was approximately ½ inch. Using a ball which is generally spherical and has a diameter of 1½ inches constructed of styrofoam, it was found that the blower unit would maintain the ball at approximately 5 inches above the blower outlet.

There are obviously a wide variety of other area-defining movable structures which may be utilized in connection with the present invention. Such alternate forms of structure may provide for composite movement. By way of example, a propeller or motor may be provided on a movable element so that the air stream will cause the propeller to rotate to thereby impart movement to the area-defining member on which the propeller is rotatably mounted.

It will be noted that the area-defining members illustrated in FIGS. 3 through 7 have relatively thin cross-sections relative to the size of the ball. This is to minimize interference with the air stream when the movable member is interposed between the suspended ball and the blower unit. Excessive interruption of the air stream will result in loss of control and falling of the ball. In this connection, if the width of the movable member were equal to the width of the ball, the air stream would be so interrupted that control could not be maintained and the device would not operate in a satisfactoy manner. By way of example, using a ball having approximately 1½ inch diameter it has been found that a movable member wall thickness of approximately 1/16 inch produces satisfactory results and does not unduly interfere with the operation of the air stream. For a ball that size, a movable member thickness of ¼ inch or more has been found to cause problems with the satisfactory operation of the device.

Various other modifications and changes may be made in the illustrated structures without departing from the spirit and scope of the present invention which is set forth in the following claims.

What is claimed is:

1. A play device comprising a. a hand holdable blower means for providing a selectively directable air stream;

b. a floatable object having such size, shape and weight for being suspended in said air stream; and c. movable means for being disposed on a supporting surface and defining at least one area in which the object is to be positioned by being moved thereto by the air stream, said area being spaced above the supporting surface, said movable means being movable relative to the supporting surface when contacted by the air stream to thereby move the said area and thereby render it more difficult to move the object into the area.

2. A play device as set forth in claim 1 wherein said movable means defines at least two areas spaced apart from one another.

3. A play device as set forth in claim 2 wherein at least one of said areas comprises an opening for receipt of the object therein.

4. The play device as set forth in claim 2 wherein at least one of said areas comprises an aperture for passage of the object completely therethrough.

5. The play device as set forth in claim 2 wherein at least one of said areas comprises a receptacle for receiving and holding the object therein.

6. The play device as set forth in claim 1 wherein said means for providing a selectively directable air stream provides such air stream with a substantially constant thrust so as to suspend the object at a essentially constant and predetermined distance from said means.

7. The play device as set forth in claim 6 wherein said means for providing a selectively directable air stream further includes on-off switch means which are manually operable by the user to turn the air stream on and off.

8. The play device as set forth in claim 1 wherein said floatable object comprises an essentially spherical lightweight ball.

9. A play device as set forth in claim 1 wherein said movable means comprises a first movable member which defines one of said areas and a second movable means which is movable relative to said first movable means and which incident to such relative movement imparts movement to said first movable member.

10. A play device comprising a. a hand-holdable air blower unit for providing a selectively directable air stream of essentially constant thrust, said air blower including manually operable control means for turning said air stream on and off;

b. a lightweight floatable ball having such size and weight that it is capable of being suspended in said air stream; and c. means defining at least one area in which the ball is to be positioned by being moved thereto by the air stream, said means including a support structure for being disposed upon a supporting surface and movable area defining means mounted on said support structure defining at least one of said areas, said movable means being movable relative to said support structure when contacted by the air stream to thereby move said area and thereby render it more difficult to move the ball into the area, said area being spaced substantially above the supporting surface.

11. A play device as set forth in claim 10 wherein said movable means defines at least two areas spaced apart from one another.

12. A play device as set forth in claim 11 where at least one of said areas comprises an opening for receipt of the object therein.

13. A play device as set forth in claim 11 wherein said movable means is rotatably mounted on said support structure.

14. A play device as set forth in claim 10 wherein said floatable ball is essentially spherical and is made of lightweight foam plastic material.

15. A method of manipulating an object relative to one or more areas, the method comprising the steps of a. providing a hand-held blower device operable to provide a directional air stream of generally constant thrust;

b. providing a floatable object having such size, weight and shape to be capable of being suspended in said air stream;

c. providing on a supporting surface at least one movable structure which defines at least one area elevated above the surface in which the object is to be positioned by the air stream, the movable structure being moved relative to the supporting surface when contacted by the air stream; and d. manipulating the blower unit by selectively changing its location and also selectively changing its orientation to suspend the object in the air stream and to move the object into said elevated area.

16. The method of claim 15 wherein there are at least two spaced apart elevated areas in which the object is to be positioned by the air stream, the step of manipulating the blower unit being carried out so as to move the object sequentially into one of the elevated areas and then to another of the elevated areas in a predetermined sequence.

17. The method of claim 16 wherein the blower unit is manipulated to move the object from area to area along both horizontal and vertical paths.

18. The play device of claim 10 wherein said blower unit is self contained, having an electric motor and battery means carried thereon.

* * * * *